US009981781B2

(12) United States Patent
Kurmis

(10) Patent No.: US 9,981,781 B2
(45) Date of Patent: May 29, 2018

(54) SEALING ASSEMBLY FOR A CLOSURE

(76) Inventor: Manfred Imand Kurmis, Adelaide (AU)

( * ) Notice: Subject to any disclaimer, the term of this patent is extended or adjusted under 35 U.S.C. 154(b) by 959 days.

(21) Appl. No.: 13/996,964

(22) PCT Filed: Dec. 21, 2011

(86) PCT No.: PCT/AU2011/001659

§ 371 (c)(1),
(2), (4) Date: Jun. 21, 2013

(87) PCT Pub. No.: WO2012/083368

PCT Pub. Date: Jun. 28, 2012

(65) Prior Publication Data

US 2013/0276413 A1 Oct. 24, 2013

(30) Foreign Application Priority Data

Dec. 23, 2010 (AU) ..... 2010905638

(51) Int. Cl.
*B65D 41/04* (2006.01)
*B65D 41/34* (2006.01)
(Continued)

(52) U.S. Cl.
CPC ..... *B65D 41/045* (2013.01); *B65D 41/0435* (2013.01); *B65D 41/348* (2013.01); *B65D 41/0414* (2013.01); *B65D 41/0421* (2013.01); *B65D 41/58* (2013.01); *B65D 51/04* (2013.01); *B65D 51/18* (2013.01); *B65D 53/04* (2013.01); *B65D 2251/0015* (2013.01);
(Continued)

(58) Field of Classification Search
None
See application file for complete search history.

(56) References Cited

U.S. PATENT DOCUMENTS 3,074,579 A * 1/1963 Miller ..... B65D 41/0421 138/96 T
3,439,825 A * 4/1969 Glensky ..... B65D 41/42 215/251
(Continued)

FOREIGN PATENT DOCUMENTS

DE 102009024451 A1 * 12/2010 ..... B65D 41/28
GB 1467028 A 3/1977
WO WO-2010/099566 A1 9/2010

OTHER PUBLICATIONS

International Search Report for PCT/AU2011/001659, dated Feb. 27, 2012; ISA/AU.

*Primary Examiner* — Hemant M Desai
*Assistant Examiner* — Mobeen Ahmed
(74) *Attorney, Agent, or Firm* — Harness, Dickey & Pierce, P.L.C.

(57) ABSTRACT

A sealing assembly for a closure is disclosed where the closure is for applying to an opening. The sealing assembly includes a substantially rigid cap portion for seating the sealing assembly in a roof portion of the closure and an insert portion attachable to the cap portion. The insert portion includes a flexible skirt portion extending from the insert portion and operable to contact an inner wall region of the opening on application of the closure to the opening. In one embodiment, the sealing assembly is for closures for sealing bottles of sparkling wine and the like.

15 Claims, 8 Drawing Sheets

(51) Int. Cl.
*B65D 51/04* (2006.01)
*B65D 51/18* (2006.01)
*B65D 41/58* (2006.01)
*B65D 53/04* (2006.01)

(52) U.S. Cl.
CPC ..... *B65D 2251/0078* (2013.01); *B65D 2543/00092* (2013.01); *B65D 2543/00296* (2013.01); *B65D 2543/00518* (2013.01)

(56) References Cited

U.S. PATENT DOCUMENTS 3,462,035 A * 8/1969 Grussen ..... B65D 41/485 215/253
3,517,847 A * 6/1970 Piergiacomo ..... B65D 41/32 215/256
3,630,404 A * 12/1971 Guala ..... B65D 41/58 215/251
3,888,373 A * 6/1975 Gach ..... B65D 50/046 215/214
3,905,502 A * 9/1975 Wassilieff ..... B65D 45/322 215/250
4,192,428 A * 3/1980 Segmuller ..... B65D 51/18 215/256
4,925,055 A * 5/1990 Robbins, III ..... A61J 1/05 215/12.1
5,275,287 A * 1/1994 Thompson ..... B65D 41/0421 215/341
5,503,282 A * 4/1996 Montgomery ..... B65D 41/045 215/252
5,785,196 A * 7/1998 Montgomery ..... B65D 41/0414 215/270
5,823,372 A * 10/1998 Levine ..... B65B 31/047 215/228
5,857,580 A * 1/1999 Iidaka ..... B65D 41/60 215/250
5,988,923 A * 11/1999 Arai ..... B65D 47/42 215/329
6,041,982 A * 3/2000 Cautereels ..... B65D 25/48 215/307
6,338,414 B1 * 1/2002 Schellenbach ..... B65D 41/0421 215/252
6,616,012 B2 * 9/2003 Dark ..... B65D 47/2081 222/1
6,843,389 B2 * 1/2005 Kasting ..... B65D 25/2867 215/344
6,997,354 B2 * 2/2006 Kasting ..... B65D 25/2867 215/344
7,048,140 B1 * 5/2006 Caldwell ..... B60T 11/22 215/308
7,308,988 B2 * 12/2007 Yashima ..... B65D 41/265 215/344
8,191,728 B2 * 6/2012 Auer ..... A47J 36/027 215/216
8,297,483 B2 * 10/2012 Korakh ..... B65D 51/10 222/188
8,820,553 B2 * 9/2014 Endert ..... B65D 43/0212 215/272
2003/0021919 A1 * 1/2003 Granger ..... B65D 41/0428 428/34.1
2005/0224445 A1 * 10/2005 Gancia ..... B65D 41/0442 215/204
2007/0138125 A1 * 6/2007 Granger ..... B21D 51/50 215/312
2009/0008356 A1 * 1/2009 Gadzic ..... B65D 47/265 215/310
2010/0018940 A1 * 1/2010 Granger ..... B65D 49/00 215/26
2010/0163511 A1 * 7/2010 Cappello ..... B65D 51/1616 215/329
2010/0264110 A1 * 10/2010 Sumimiya ..... B65D 41/045 215/329
2013/0112688 A1 * 5/2013 Krikor ..... A23L 2/42 220/212
2015/0060389 A1 * 3/2015 Bolger ..... B65D 39/0052 215/355

* cited by examiner

SEALING ASSEMBLY FOR A CLOSURE

CLAIM OF PRIORITY

The present application for patent claims priority from Australian Provisional Patent Application No. 2010905638 entitled "A SEALING ASSEMBLY FOR A CLOSURE", filed Dec. 23, 2010, which is hereby expressly incorporated by reference herein in its entirety.

TECHNICAL FIELD

The present invention relates to closures for sealing an opening. In a particular form, the present invention relates to a sealing assembly for a closure used in the sealing of wine bottles and other bottled beverages.

BACKGROUND

Screw caps are a common form of closure employed to seal a large range of containers such as plastic and glass bottles for liquids including beverages ranging from soft drinks to wine. For bottled wines, screw caps are generally made of aluminium and have now become increasingly popular as a replacement for the traditional cylindrical cork due to concerns about cork taint and variability of quality of cork material which can lead to a poor seal and the associated premature oxidation of wine. While initially screw caps were associated with budget wines they are now commonly used for the packaging of premiums wine due to their inherent reliability.

Referring now to FIG. 1, there is shown a cutaway view of a roll on tamper evident (ROTE) screw cap 100 for a wine bottle 200. Screw cap 100 consists of an outer sleeve 110 formed of a malleable aluminium alloy which is rolled on to the opening 250 of bottle 200. Screw cap 100 further incorporates a wad or liner 120 which seats within the roof of the screw cap 100 and which forms a seal against the rim 220 of the bottle or container 200. Wad 120 may be formed of any number of materials ranging from plastic such as polyvinylidene chloride (PVDC), cork, rubber or multilayer combinations of these materials. In this example, the sealing layer 130 of wad 120 is formed from PVDC.

Screw caps of the type illustrated in FIG. 1 and more generally have the significant disadvantage that they are not suitable to seal a container containing a liquid that is at a high internal pressure. As an example, many sparkling varieties of wine are sealed at high pressure and the screw cap is simply not able to withstand the internal pressure exerted by the contents of the bottle. Accordingly, it is then necessary to use traditional cylindrical corks with all of their associated disadvantages. In an earlier filed patent application (PCT Application No. PCT/AU2010/00237) the present applicant disclosed a sealing member for a closure suitable for the sealing of bottles containing liquids at high pressure such as sparkling wines and the like. While the disclosed arrangement has provided acceptable performance, the applicant has developed further improvements which are now the subject of this application.

SUMMARY

A sealing assembly for a closure, the closure for applying to an opening, the sealing assembly including:

a substantially rigid cap portion for seating the sealing assembly in a roof portion of the closure; and an insert portion attachable to the cap portion, the insert portion including a skirt portion, the skirt portion flexible relative to the cap portion and extending from the insert portion, the skirt portion operable to contact an inner wall region of the opening on application of the closure to the opening.

In another form, the cap region includes a centrally disposed attachment region to which the insert portion is attached to.

In another form, the skirt portion is biased against the inner wall region of the opening on application of the closure to the opening.

In another form, the insert portion is rotatably attached to the cap portion.

In another form, the centrally disposed attachment region includes a centrally located aperture, the aperture adapted to receive a corresponding projection on the insert portion.

In another form, the cap portion includes a downwardly extending wall portion, the wall portion to be received in a corresponding channel surrounding the projection of the insert portion to increase the rigidity of a central region of the insert portion relative to the flexible skirt portion of the insert portion.

In another form, the closure is a screw cap closure.

In another form, the cap portion forms one layer of a composite liner or wad used in the screw closure.

In another form, the closure is a roll on tamper evident (ROTE) closure and wherein the periphery of the rigid cap portion is adapted to be retained within a roof portion of the closure prior to roll forming of the ROTE closure onto an opening.

In another form, the opening is for a container of fluid.

In another form, the container is for a pressurised fluid and wherein the skirt portion under the action of the internal pressure of the pressurised fluid is operable to be forced against the inner wall region to further seal the opening.

In another form, the cap portion and the insert portion are formed as individual unitary members.

In another form, the closure is resealable.

In a second aspect the present invention accordingly provides a method for sealing an opening of a container containing a fluid, the method including:

applying a closure to the opening, the closure including a sealing assembly that includes a substantially rigid cap portion for seating the sealing assembly in a roof portion of the closure; and an insert portion attachable to the cap portion, the insert portion including a skirt portion, the skirt portion flexible relative to the cap portion and extending from the insert portion, the skirt portion operable to contact an inner wall region of the opening on application of the closure to the opening.

In another form, the closure screw threadably engages with the opening of the container.

In another form, the closure is a roll on tamper evident (ROTE) closure.

In a third aspect the present invention accordingly provides a sealing assembly for a closure for sealing the opening of a container of pressurised fluid, the sealing assembly including:

a substantially rigid cap portion for seating the sealing assembly in a roof portion of the closure;

an insert portion attachable to the cap portion and including a skirt portion flexible relative to the cap portion, the skirt portion configured to provide a first level of sealing on application of the sealing assembly to the opening and further configured to provide a second level of sealing under the action of the internal pressure of the pressurised fluid in the container.

In another form, the skirt portion is biased against an inner wall region of the opening on application of the closure to the opening to provide the first level of sealing.

In another form the skirt portion is operable to be forced against an inner wall region of the opening under the action of the internal pressure of the pressurised fluid in the container to provide the second level of sealing.

A container sealed by a closure, the closure including a sealing assembly according to the first or third aspects of the present invention.

BRIEF DESCRIPTION OF THE DRAWINGS

Illustrative embodiments of the present invention will be discussed with reference to the accompanying drawings wherein.

In the following description, like reference characters designate like or corresponding parts throughout the several views of the drawings.

DETAILED DESCRIPTION

Figure 1:
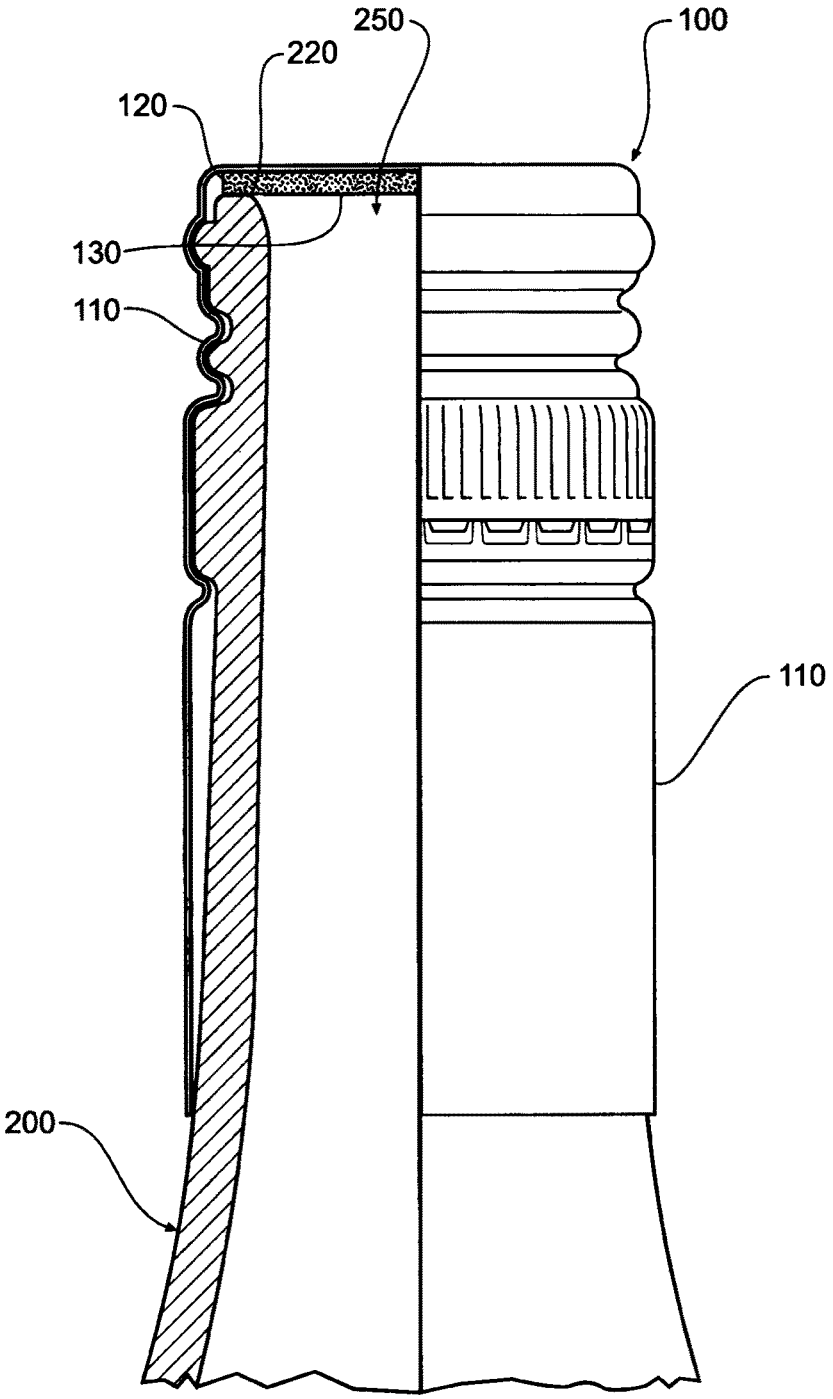
Figure 1 (Prior Art)
FIG. 1 is a cutaway part-sectional side view of a prior art closure in the form of a screw cap.
Figure 2A:
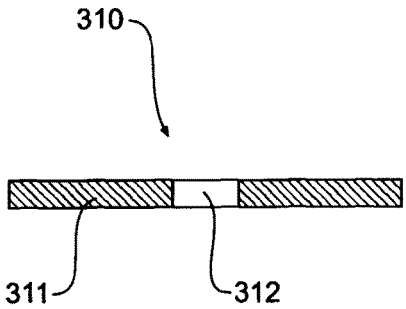
FIGS. 2(*a*) to (*d*) depict sectional and underside views of the components of a sealing assembly for a closure according to a first illustrative embodiment of the present invention.
Figure 2B:
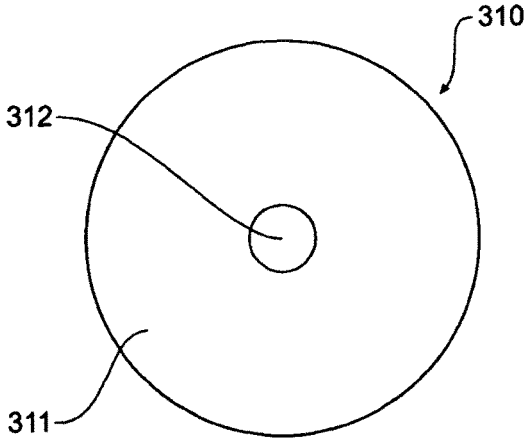
Figure 2C:
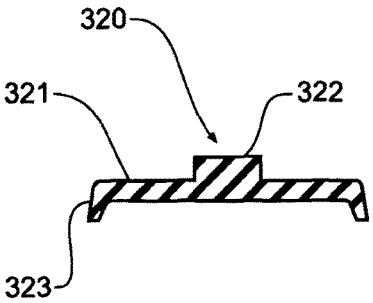
Figure 2D:
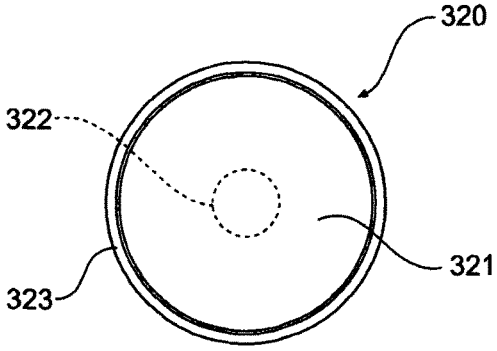
Figure 3A:
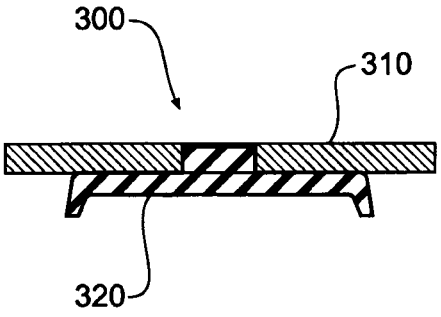
FIGS. 3(*a*) and (*b*) depict sectional and underside views of a sealing assembly for a closure assembled from the components illustrated in FIG. 2.
Figure 3B:
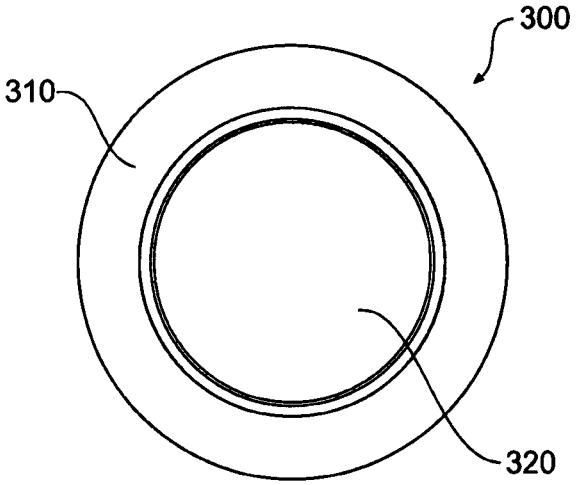
Figure 4:
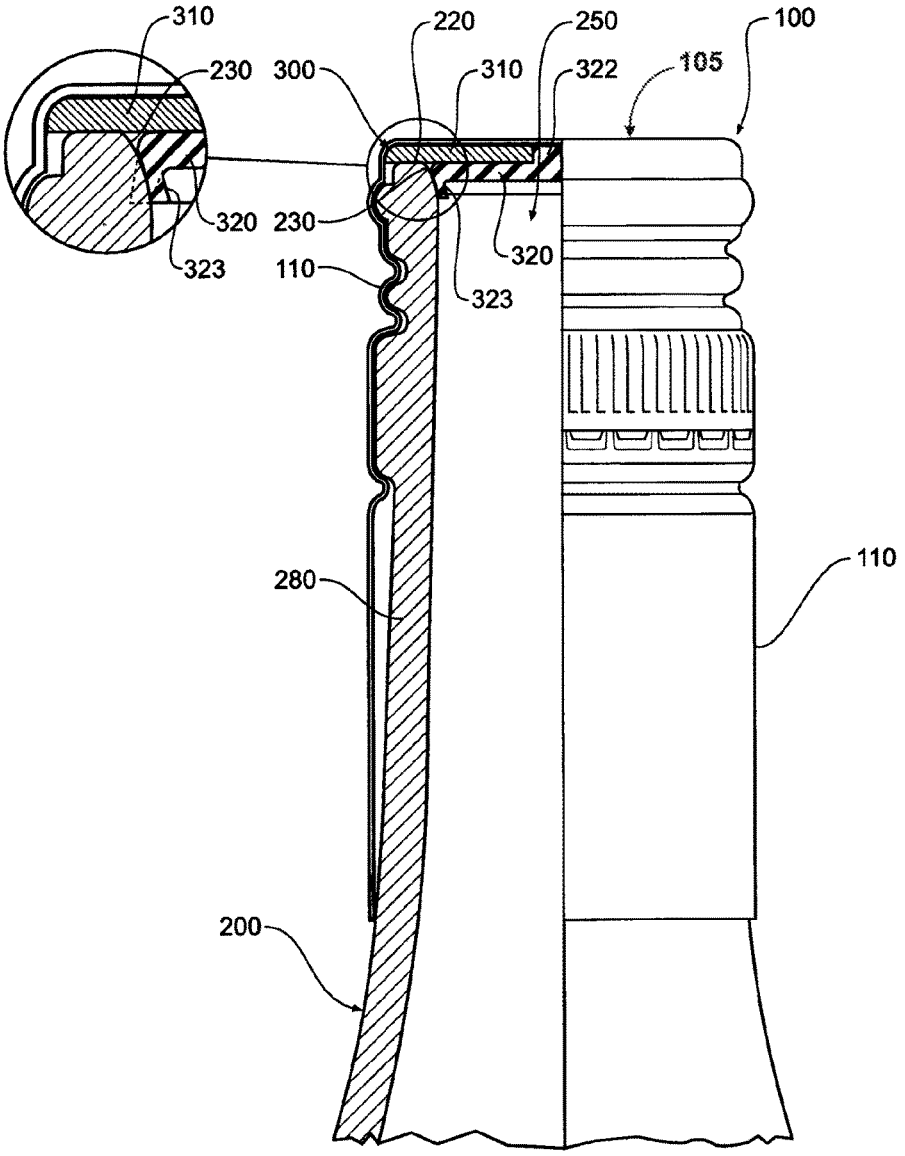
FIG. 4 is a cutaway part-sectional side view of the sealing assembly illustrated in FIG. 3 in combination with the screw cap type closure illustrated in FIG. 1.
Figure 5A:
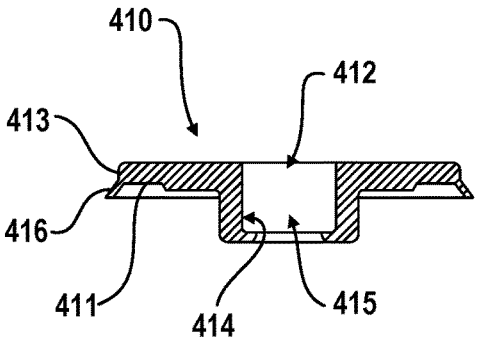
FIGS. 5(*a*) to (*d*) depict sectional and underside views of the components of a sealing assembly for a closure according to a second illustrative embodiment of the present invention.
Figure 5B:
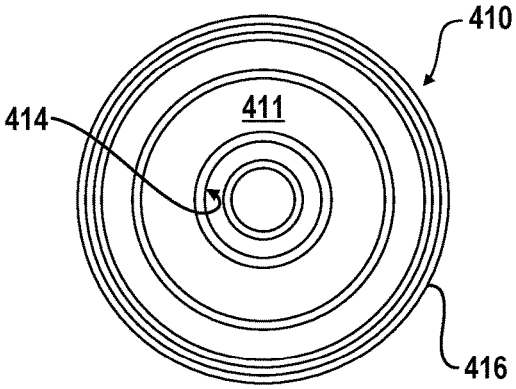
Figure 5C:
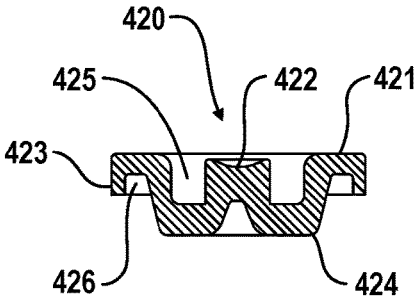
Figure 5D:
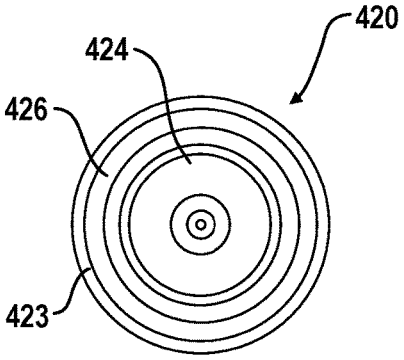

Referring now to FIGS. 2 to 4, there are shown various views of a sealing assembly 300 for a closure 100 in accordance with a first illustrative embodiment of the present invention. In this illustrative embodiment, and as illustrated in FIG. 4, the closure 100 is a standard ROTE screw cap 100 as typically employed for wine bottles. However, as would be apparent to one of ordinary skill in the art, the present invention is applicable to the sealing of any general opening having a rim that a respective closure may be applied to.

Sealing assembly 300 includes a substantially rigid cap portion 310 which in this illustrative embodiment is a circular disc 311 which seats in the roof of closure 100 (as best seen in FIG. 4) and an insert portion 320 which on assembly is attached to cap portion 310. In this illustrative embodiment, this attachment is achieved via a centrally disposed attachment region in the form of an aperture 312 that receives a corresponding centrally disposed projection 322 located on the body 321 of insert portion 320 (as best seen in FIG. 3(*a*)). In this illustrative embodiment, the cap portion 310 and insert portion 320 may be press fitted together or alternatively be attached using an appropriate adhesive. Similarly, cap portion 310 may either be press fitted or attached to the roof of closure 100 by a suitable adhesive.

Insert portion 320 further includes a flexible skirt portion 323 (i.e. flexible relative to rigid cap portion 310) extending generally downwardly from the body 321 of insert portion 320. Skirt portion 323 is circular in shape to match the shape of the opening 250 of bottle 200 and suitably sized to contact the inner wall region 230 of the rim 220 of the opening of the bottle 200. In this illustrative embodiment, insert portion 320 is formed of a flexible food safe material such as a thermoplastic vulcanizate (TPV) elastomer which may be injection moulded as a unitary body. In another illustrative embodiment, insert portion 320 may include a combination of a rigid body 321 combined with a flexible skirt portion 323. In one particular embodiment, the TPV material may be Santoprene™ 271-55 or 271-80 grade material. Alternatively, other food safe flexible materials may be employed depending on the required sealing characteristics.

In this illustrative embodiment, cap portion 310 is formed of a substantially rigid material such as NORYL™ GFN2 which is a standard 20% glass fibre reinforced polyphenylene ether (PPO) material which again may be injection moulded as a unitary body. Other suitable materials may include polyethylene terephthalate (PET) based formulations. In another illustrative embodiment, the cap portion 310 may form one layer of a composite liner or wad used in screw cap closure 100.

Closure 100 incorporating sealing assembly 300 is applied to the opening 250 of bottle 200 in the standard manner by pushing closure 100 onto the neck 280 of bottle 200 and then roll forming closure 100 onto the neck 280 using a standard roll forming process as is known in the art. In this illustrative embodiment, skirt portion 323 is flared or tapers outwardly and on application of the sealing assembly to opening 250 is able to be flexed inwardly due to its flexibility thereby causing the skirt portion 323 to be biased or have a preload against the inner wall region 230 of the rim 220 of the bottle 200 to provide a first level of sealing as best seen in FIG. 4. In the event, that the bottle contains a pressurised fluid such as champagne or other pressurised liquid or gas or combination of both, the internal pressure of the bottle or container further forces the flexible skirt portion 323 against the inner wall region 230, thereby providing a second level of sealing between the sealing assembly 300 and the opening 250 of the bottle 200. As can be seen in FIG. 4, the rim 220 of bottle 200 may be radiused to facilitate the loading or bending of skirt portion 323 as sealing assembly 300 is applied to the opening 250 of bottle 200.

As the cap portion 310 is substantially rigid, it forms a rigid support base for insert portion 320 which improves the structural rigidity of the roof portion of screw cap closure 100 and prevents movement of sealing assembly 300 with respect to the inner wall region 230 resulting in improved sealing characteristics of flexible skirt portion 323. In addition, the rigidity of cap portion 310 prevents outward deformation or doming of the roof portion of screw cap closure 100 which not only improves the cosmetics of the closure but also aids in storage and transportation of bottles 200. On the other hand, the flexibility of the insert portion 320 and especially flexible skirt portion 323 is able to compensate for manufacturing irregularities that may occur in the shape of the opening 250 of the bottle 200 ensuring sealing assembly 300 provides a more fault tolerant seal.

Figure 6A:
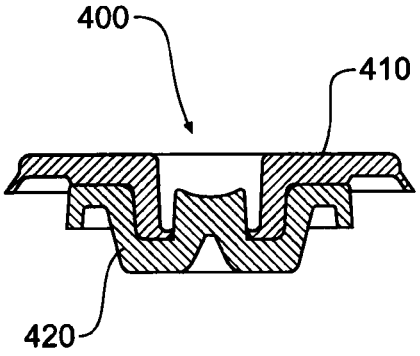
FIGS. 6(*a*) and (*b*) depicts sectional and underside views of a sealing assembly for a closure assembled from the components illustrated in FIG. 5.
Figure 6B:
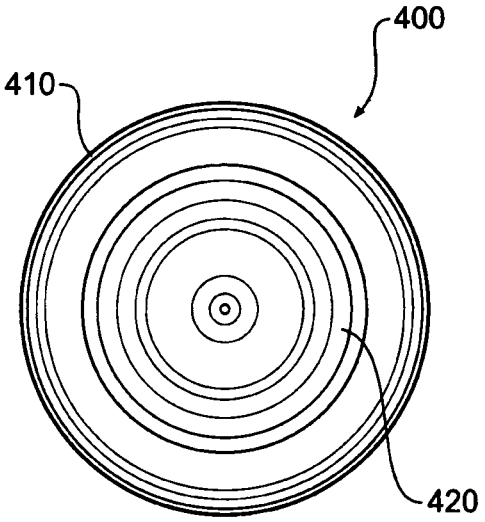
Figure 7:
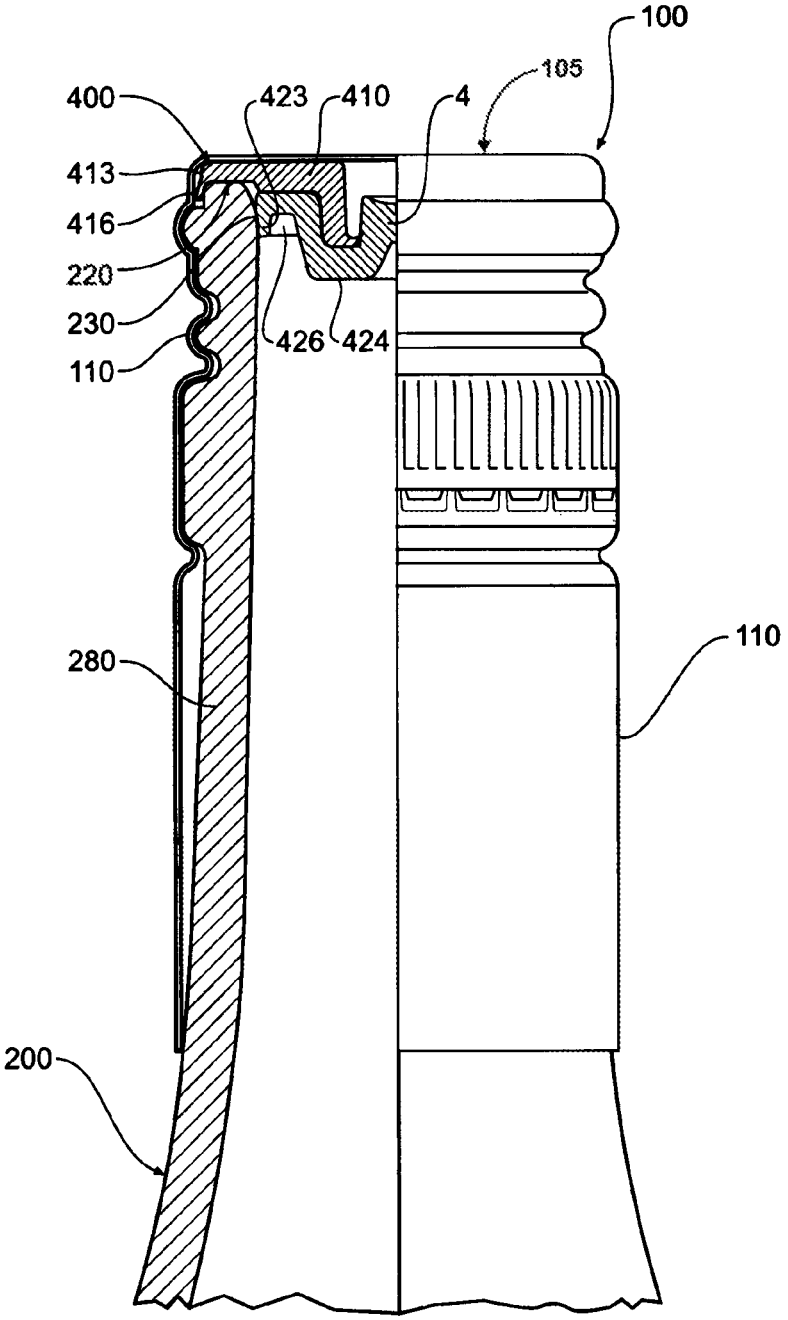
FIG. 7 is a cutaway part-sectional side view of the sealing assembly illustrated in FIGS. 6(*a*) and (*b*) in combination with the screw cap type closure illustrated in FIG. 1.

Referring now to FIGS. 5 to 7, there is shown various views of a sealing assembly 400 in accordance with a second illustrative embodiment of the present invention. As with the first embodiment, sealing assembly 400 is designed to be used in combination with a standard screw cap closure 100 of the type that is typically applied to a wine bottle or the like. Sealing member 400 includes a cap portion 410 and insert portion 420.

In this illustrative embodiment, cap portion 410 is once again formed from a substantially rigid material and includes a generally flattened cylindrically shaped body 411, a peripheral rim portion 413, outwardly extending skirt portion 416 and a central aperture 412 surrounded by a peripheral downwardly extending annular shaped wall portion 414 forming a cylindrically shaped cavity or receiving region 415.

Insert portion 420 is again formed as a unitary body having a generally inverted top hat configuration with a central stepped region 424, a circumferential rim region 421, and a peripheral flexible skirt portion 423 (as best seen in FIG. 5(*c*)) spaced apart from the central stepped region 424 by rim region 421 and forming a circumferential valley region 426 formed between the step region 424 and flexible skirt portion 423. Stepped region 424 is formed having a generally cylindrical configuration which in this illustrative embodiment has a slight inward taper to facilitate manufacture.

Formed behind and in the stepped region 424 is a complementary receiving region 425, which in this illustrative embodiment is a circular groove or channel surrounding a centrally disposed projection 422 configured to receive the annular wall portion 414 of cap portion 410 within stepped region 424. Similarly, central projection 422 is configured to be inserted into receiving region 415 located on cap portion 410 (as best seen in FIG. 6(*a*)). In this manner, cap portion 410 and insert portion 420 may be attached together on assembly. As annular shaped wall portion 414 is formed of a substantially rigid material it functions to further reinforce the stepped region 424 and rim region 421 against any movement relative to cap portion 410.

Figure 8:
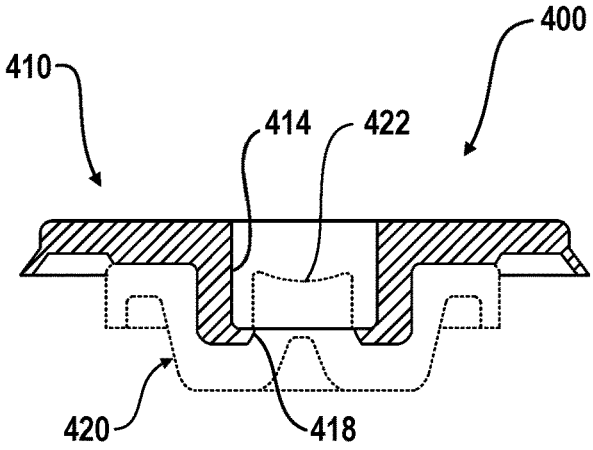
FIG. 8 is a detailed sectional view of the sealing assembly illustrated in FIGS. 6(*a*) and (*b*)

Referring now to FIG. 8, there is shown a detailed sectional view of the sealing assembly 400 after assembly. In this illustrative embodiment, the wall portion 414 of cap portion 410 includes an inwardly extending projection or nib 418 that engages with the flexible or resilient side walls of central projection 422 to attach cap portion 410 and insert portion 420 together. In this manner, insert portion 420 will be rotatable with respect to cap portion 410 while remaining attached during normal usage.

Similar to sealing assembly 300, in operation the flexible skirt portion 423 of the insert portion 420 of sealing assembly 400 is biased against the inner wall portion 230 of the rim 220 of bottle 200 causing it to sealingly engage with the inner wall portion 230 to form an initial seal due to the skirt portion 423 being preloaded inwardly on application of sealing assembly 400 to bottle 200. In addition, skirt portion 423 is operable to be forced against inner wall portion 423 under the action of the internal pressure of the pressurised fluid in bottle 200 to enhance or provide a second level of sealing.

In this illustrative embodiment, the configuration of insert portion 420 further aids the sealing characteristics of sealing assembly 400 by having a central region in the form of structurally reinforced stepped region 424 which minimally flexes under pressure due to the reinforcement provided by the insertion of annular wall portion 415 of cap portion 410 into receiving region or channel 425 surrounding central projection 422.

In operation, the presence of gas or liquid under pressure in valley region 426 located adjacent to reinforced stepped region 424 will result in an increased compressive force acting outwardly on flexible skirt portion 423 as a result of the pressure of the contents of bottle 200 relative to the essentially rigid reinforced stepped region 424 and rim region 421. This combination of a reinforced central region and a flexible peripheral region functions to improve the sealing characteristics of the seal between the outwardly flexed skirt portion 423 and the inner wall portion 230 (as best seen in FIG. 7).

Furthermore, in this illustrative embodiment cap portion 410 is rotatable with respect to insert portion 420 and as a result on opening of the screw cap 100, it is not necessary to turn the skirt portion 423 with respect to the inner wall region 230. Instead, as the cap 100 is unscrewed it will move upwardly, thereby lifting cap portion 410 and with it insert portion 420 making it easier to break the seal between skirt portion 423 and inner wall region 230 as a result facilitating the opening of the bottle. In this manner, the screw cap 100 may be rotated part way (e.g. approximately a third of a turn) before the seal is broken due to the preloading of skirt portion 423 as opposed to being suddenly broken on initial opening. This allows a person opening the bottle 200 to have greater control over the pressure release. Furthermore, in this illustrative embodiment the bottle 200 may be resealed by simply reapplying the screw cap 100 as skirt portion 423 of sealing assembly 400 will flex or be preloaded inwardly again to reseal the contents of bottle 200.

Figure 9:
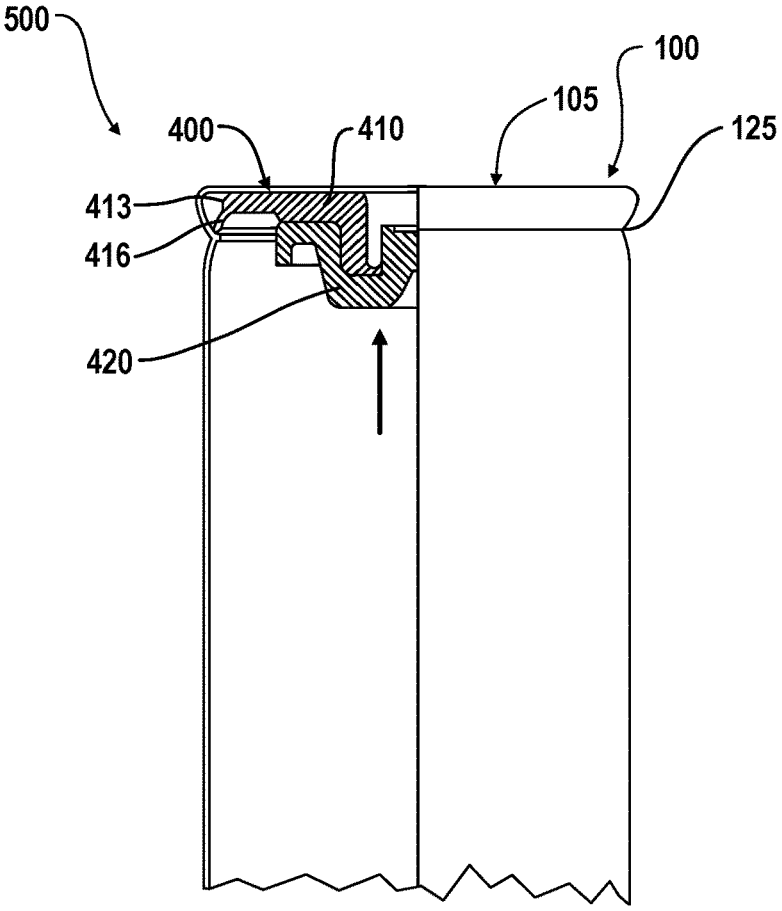
FIG. 9 is cutaway part-sectional side view of the sealing assembly illustrated in FIGS. 6(*a*) and (*b*) prior to roll forming of the screw cap type closure.

Referring now to FIG. 9, in this illustrative embodiment the outwardly extending skirt portion 416 further functions to locate sealing assembly 400 within screw cap 100 prior to the roll forming of a screw cap assembly 500 consisting of screw cap 100 and sealing assembly 400. Prior to roll forming, screw cap 100 as depicted in FIG. 9 includes a circumferential inwardly extending ridge or step 125 forming an internal tapered wall or detent region. To assemble the screw cap 100 and sealing assembly 400, the sealing assembly 400 is inserted into screw cap in the direction depicted by the arrow on FIG. 9 until the skirt portion 416 engages with ridge 125. In this manner, sealing assembly 400 is positively located upon insertion into screw cap 100 and may be conveniently transported as a combined screw cap assembly 500 for later roll forming on a bottle.

The applicant has found through testing embodiments of the invention directed to ROTE screw cap closures for sparkling wines that a closure incorporating a sealing assembly in accordance with the present invention is able maintain a pressure of 12 bar (i.e. significantly higher than that expected for sparkling wine) with no leakage or pressure decrease other than the minimal reduction in pressure due to the inherent permeability of the materials involved. Furthermore, the materials employed in the previously described embodiments are resistant to high temperatures of approximately 80° C. and as such the contents may be subject to various heating processes such as pastuerisation while still maintaining the integrity of the seal As would be appreciated by those skilled in the art, the sealing assembly of the present invention allows standard closures which otherwise would be unsuitable to seal containers containing liquid under pressure to be used in these circumstances. Furthermore, a closure incorporating a sealing assembly in accordance with the present invention is reusable in that the closure may be reapplied to the opening and the seal re-established. While the present invention is described in relation to screw cap closures for wine bottles and the like it will be appreciated that the invention will have other applications consistent with the principles described in the specification such as plastic closures having a preformed internal screw thread as often employed with carbonated beverages.

In one non-limiting example, a sealing member in accordance with the present invention may be used in combination with a NOVATWIST™ or similar type plastic cap where the conventional tin liner may be substituted with the sealing assembly described herein. In this manner, a plastic cap of this type may be used for containers containing a pressurised fluid having a standard screw thread arrangement such as the Bague Vin Suisse (BVS) bottle finish that is typically employed for wine bottles.

The reference to any prior art in this specification is not, and should not be taken as, an acknowledgement of any form of suggestion that such prior art forms part of the common general knowledge.

Although illustrative embodiments of the present invention have been described in the foregoing detailed description, it will be understood that the invention is not limited to the embodiment disclosed, but is capable of numerous rearrangements, modifications and substitutions without departing from the scope of the invention as set forth and defined by the following claims.

The invention claimed is:

1. A two-component sealing assembly for a roll on tamper evident closure, the roll on tamper evident closure for applying to an opening, the sealing assembly including:

a substantially rigid cap portion for seating the two-component sealing assembly in a roof portion of the roll on tamper evident closure, the substantially rigid cap portion including a flattened cylindrically shaped body having a peripheral rim and a central aperture surrounded by an annular shaped wall portion; and an insert portion attachable to the substantially rigid cap portion, the insert portion including a skirt portion and a central projection that is received in the central aperture of the substantially rigid cap portion, the skirt portion being flexible relative to the substantially rigid cap portion, the skirt portion of the insert portion arranged radially inward of the peripheral rim of the flattened cylindrically shaped body of the substantially rigid cap portion, leaving at least part of the flattened cylindrically shaped body of the substantially rigid cap portion exposed, such that the flattened cylindrically shaped body of the substantially rigid cap portion is operable to seat against a rim of the opening and the skirt portion of the insert portion is operable to contact an inner wall region of the opening on application of the roll on tamper evident closure to the opening and where the substantially rigid cap portion is rotatable with respect to the insert portion and where the annular shaped wall portion of the substantially rigid cap portion includes a radially inwardly extending projection that engages the central projection of the insert portion and is configured to prevent axial movement of the insert portion relative to the substantially rigid cap portion while permitting relative rotation of the insert portion relative to the substantially rigid cap portion.

2. The two-component sealing assembly of claim 1, wherein the annular shaped wall portion of the substantially rigid cap portion is received in a corresponding channel in the insert portion, the channel surrounding the central projection of the insert portion to increase the rigidity of a central region of the insert portion relative to the skirt portion of the insert portion.

3. The two-component sealing assembly of claim 1, wherein the roll on tamper evident closure is a three-component screw cap roll on tamper evident closure.

4. The two-component sealing assembly of claim 1, wherein the substantially rigid cap portion forms one layer of a composite liner or wad used in a screw cap of a roll on tamper evident closure.

5. The two-component sealing assembly of claim 1, wherein the peripheral rim of the substantially rigid cap portion is adapted to be retained within the roof portion of the roll on tamper evident closure prior to roll forming the roll on tamper evident closure.

6. The two-component sealing assembly of claim 5, wherein the opening is for a container of pressurized fluid.

7. The two-component sealing assembly of claim 6, wherein the skirt portion, under the action of the internal pressure of the pressurized fluid, is operable to be forced against the inner wall region to further seal the opening.

8. The sealing two-component assembly of claim 1, wherein the roll on tamper evident closure is resealable.

9. A method for sealing an opening of a container containing a pressurized fluid, the method including:

applying a three-component roll on tamper evident closure to the opening, the a three-component roll on tamper evident closure including a two-component sealing assembly that includes a substantially rigid cap portion for seating the two-component sealing assembly in a roof portion of the three-component roll on tamper evident closure, the substantially rigid cap portion including a flattened cylindrically shaped body having a peripheral rim and a central aperture surrounded by an annular shaped wall portion; and an insert portion attachable to the substantially rigid cap portion, the insert portion including a skirt portion and a central projection that is received in the central aperture of the substantially rigid cap portion, the skirt portion being flexible relative to the substantially rigid cap portion, the skirt portion of the insert portion arranged radially inward of the peripheral rim of the flattened cylindrically shaped body of the substantially rigid cap portion, leaving at least part of the flattened cylindrically shaped body of the substantially rigid cap portion exposed, such that the flattened cylindrically shaped body of the substantially rigid cap portion is operable to seat against a rim of the opening and the skirt portion of the insert portion is operable to contact an inner wall region of the opening on application of the three-component roll on tamper evident closure to the opening and where the substantially rigid cap portion is rotatable with respect to the insert portion and where the annular shaped wall portion of the substantially rigid cap portion includes a radially inwardly extending projection that engages the central projection of the insert portion and is configured to prevent axial movement of the insert portion relative to the substantially rigid cap portion while permitting relative rotation of the insert portion relative to the substantially rigid cap portion.

10. The method of claim 9, wherein a roll on tamper evident closure screw threadably engages with the opening of the container.

11. A container sealed by a three-component roll on tamper evident closure, the three-component roll on tamper evident closure including a rotatable two-component sealing assembly according to claims 1 or 9.

12. The two-component sealing assembly of claim 1, wherein the substantially rigid cap portion, to prevent pressure flexing, is rotatable relative to the insert portion, whilst the skirt portion is biased against the inner wall region of the opening.

13. The two-component sealing assembly of claim 1, wherein the substantially rigid cap portion and the insert portion are formed as individual unitary members that are attached to form a composite rotatable seal liner.

14. The two-component sealing assembly of claim 1, wherein the substantially rigid cap portion further includes a skirt that extends outwardly from the peripheral rim of the flattened cylindrically shaped body.

15. The two-component sealing assembly of claim 1, wherein the insert portion is permanently and rotatably attached to the substantially rigid cap portion such that the insert portion remains attached to the substantially rigid cap portion when the two-component sealing assembly is removed from the opening.

* * * * *